US007360841B2

(12) United States Patent
Barlow et al.

(10) Patent No.: US 7,360,841 B2
(45) Date of Patent: Apr. 22, 2008

(54) ARTICULATING LEG REST FOR A WHEELCHAIR

(75) Inventors: Richard T. Barlow, Clarks Summit, PA (US); Stephen J. Antonishak, Alden, PA (US); John C. Carminati, Harvey's Lake, PA (US); Kip D. Alder, West Pittston, PA (US)

(73) Assignee: Pride Mobility Products Corporation, Exeter, PA (US)

( * ) Notice: Subject to any disclaimer, the term of this patent is extended or adjusted under 35 U.S.C. 154(b) by 169 days.

(21) Appl. No.: 11/252,482

(22) Filed: Oct. 18, 2005

(65) Prior Publication Data

US 2006/0086202 A1 Apr. 27, 2006

Related U.S. Application Data

(60) Provisional application No. 60/620,578, filed on Oct. 20, 2004.

(51) Int. Cl.
*A47C 20/00* (2006.01)

(52) U.S. Cl. ..... 297/423.36; 297/DIG. 4; 297/423.3; 280/304.1

(58) Field of Classification Search ..... 297/423.36, 297/423.34, 423.3, 423.26, DIG. 4, 423.35; 280/304.1, 250.1
See application file for complete search history.

(56) References Cited

U.S. PATENT DOCUMENTS

| | | | | | |
|---|---|---|---|---|---|
| 2,913,738 | A | * | 11/1959 | Wise | 5/616 |
| 3,112,001 | A | | 11/1963 | Wise | |
| 4,365,836 | A | * | 12/1982 | Jackson et al. | 297/85 |
| 4,691,962 | A | | 9/1987 | Holdt | 297/84 |
| 4,795,214 | A | | 1/1989 | Holdt | 297/443 |
| 4,949,408 | A | | 8/1990 | Trkia | 5/86 |
| 4,966,379 | A | | 10/1990 | Mulholland | 280/242.1 |
| 5,033,793 | A | | 7/1991 | Quintile | 297/433 |
| 5,098,158 | A | * | 3/1992 | Palarski | 297/330 |
| 5,352,020 | A | | 10/1994 | Wade et al. | 297/423.26 |
| 5,402,544 | A | * | 4/1995 | Crawford et al. | 5/616 |
| 5,556,157 | A | | 9/1996 | Wempe | 297/68 |
| 5,613,967 | A | | 3/1997 | Engelhardt et al. | 606/61 |
| 5,779,316 | A | | 7/1998 | Sugawa et al. | 297/423.26 |
| 5,790,997 | A | | 8/1998 | Ruehl | 5/618 |
| 5,868,461 | A | | 2/1999 | Brotherston | 297/84 |
| 6,119,980 | A | | 9/2000 | Ferry | 244/122 R |
| 6,126,186 | A | | 10/2000 | Mascari | 280/220 |
| 6,129,415 | A | | 10/2000 | Galloway | 297/68 |
| 6,168,238 | B1 | | 1/2001 | Hannagan | 297/423.3 |
| 6,206,393 | B1 | | 3/2001 | Mascari et al. | 280/220 |

(Continued)

*Primary Examiner*—Milton Nelson, Jr.
(74) *Attorney, Agent, or Firm*—DLA Piper US LLP

(57) ABSTRACT

An articulating leg rest is provided having a first member pivotally connected to a base frame. The base frame may be either connected to or part of a wheelchair frame. A second member is telescopically received by the first member. A drive system includes a motor-driven lead screw. First and second housings each have internally threaded portions engaged with the lead screw. A link connects the first housing to the base frame. The second housing engages the second member. Rotation of the lead screw advances the first housing along the lead screw, moving the link and causing the first and second members to rotate relative to the base frame. Rotation of the lead screw also advances the second housing along the lead screw, causing the second housing to linearly translate the second member relative to the first member.

17 Claims, 8 Drawing Sheets

U.S. PATENT DOCUMENTS 6,450,581 B1 9/2002 Koerlin ..... 297/423.26
6,540,250 B1 4/2003 Peterson ..... 280/657
6,547,332 B2 * 4/2003 Pejathaya ..... 297/362.14
6,585,279 B1 * 7/2003 Galloway et al. ..... 280/304.1
7,069,608 B2 * 7/2006 Failor et al. ..... 5/618

* cited by examiner

ARTICULATING LEG REST FOR A WHEELCHAIR

CROSS REFERENCE TO RELATED APPLICATION

This application claims priority from U.S. Provisional Patent Application No.: 60/620,578 filed on Oct. 20, 2004.

FIELD OF THE INVENTION

The present invention relates to leg rests for wheelchairs. More particularly, the present invention relates to an articulating leg rest for a wheelchair providing for elevation and extension of a foot rest.

BACKGROUND OF THE INVENTION

It is known to provide wheelchairs with leg rests secured to the frame of the wheelchair, the leg rests including foot rests for supporting an occupant's feet. It is further known to pivotally couple such leg rests to the wheelchair, such that the leg rest and foot rest is movable between a lowered position in which the user's feet are positioned for operation of the wheelchair and a raised position, or positions, in which the user's feet are elevated from the lowered position.

Typically, the axis of rotation for the pivoting leg rest is offset from the axis of rotation of an occupant's legs, located at the knee joint. This offset between the two axes of rotation tends to drive an occupant's feet toward the user's knee as the leg rest is pivoted to raise the foot rest, potentially causing an undesirable compression of an occupant's legs.

To address the undesirable effects of the offset between the rotational axes, prior art wheelchairs have included foot rests that are extendable with respect to a remainder of the leg rest. Typically, such wheelchairs include a lower foot rest support member telescopically received by an upper pivoting member. Examples of such wheelchairs are shown in U.S. Pat. No. 5,033,793 to Quintile; U.S. Pat. No. 5,328,247 to Lovins; and U.S. Pat. No. 5,259,664 to Cottle.

A need exists for a powered extendible and retractable leg rest having a novel, simple, and robust mechanism to extend and retract the leg rest in accordance with rotation of the leg rest.

SUMMARY OF THE INVENTION

In a first aspect, the invention is an articulating leg rest comprising a base frame and a first member pivotably connected to the base frame for rotation about a pivot axis between a lowered position and a raised position. A second member is telescopically received by the first member for rotation with the first member and for linear translation relative to the first member between a retracted position and an extended position. A drive system is provided, including a motor supported by the first member. A lead screw is operably coupled to the motor for rotation, the lead screw having a first end and a second end. A first housing having an internally threaded portion operably engages the lead screw. A link has a first end operably connected to the first housing and a second end operably coupled to the base frame. A second housing operably engages the second member and has an internally threaded portion operably engaging the lead screw. Rotation of the lead screw moves the first housing and the link to rotate the first and second elongated members relative to the base frame. Rotation of the lead screw translates the second housing and the second member relative to the first member.

In one embodiment of the invention, the lead screw has a first portion proximate the first end and a second portion proximate the second end. The first housing travels along the first portion and the second housing travels along the second portion. The first portion has threads with a first lead and the second portion has threads with a second lead. The first lead may be less than the second lead, such that for a given rotation of the lead screw, the first housing advances along the lead screw a distance which is less than a second distance which the second housing advances along the lead screw. The first portion threads may have a first handedness and the second portion threads have a second handedness such that rotation of the lead screw causes the first housing to move a first direction and the second housing to move a second direction. The leg rest may include a foot rest assembly, and is used in combination with a power wheelchair.

In a further aspect, a rotating leg rest is provided comprising a base frame and a first member pivotally connected to the base frame for rotation about a pivot axis between a lowered position and a raised position. A drive system includes a motor supported by the first member. A lead screw is operably connected to the motor for rotation. A housing has an internally threaded portion operably engaging the lead screw. A link has a first end operably connected to the housing and a second end operably coupled to the base frame. Rotation of the lead screw advances the housing along the lead screw and moves the link to rotate the first and second elongated members relative to the base frame.

In a still further aspect, an extending and retracting leg rest is provided comprising a base frame and a first member connected to the base frame. A second member is telescopically received by the first member for linear translation relative to the first member. A drive system includes a motor supported by the first member. A lead screw is operably coupled to the motor for rotation. A housing operably engages the second member and has an internally threaded portion operably engaging the lead screw. Rotation of the lead screw linearly translates the housing and the second member relative to the first member.

BRIEF DESCRIPTION OF THE DRAWINGS

For the purpose of illustrating the invention, there are shown in the drawings a form of the invention which is presently preferred; it being understood, however, that this invention is not limited to the precise arrangements and instrumentalities shown.

DETAILED DESCRIPTION OF THE INVENTION

Figure 1:
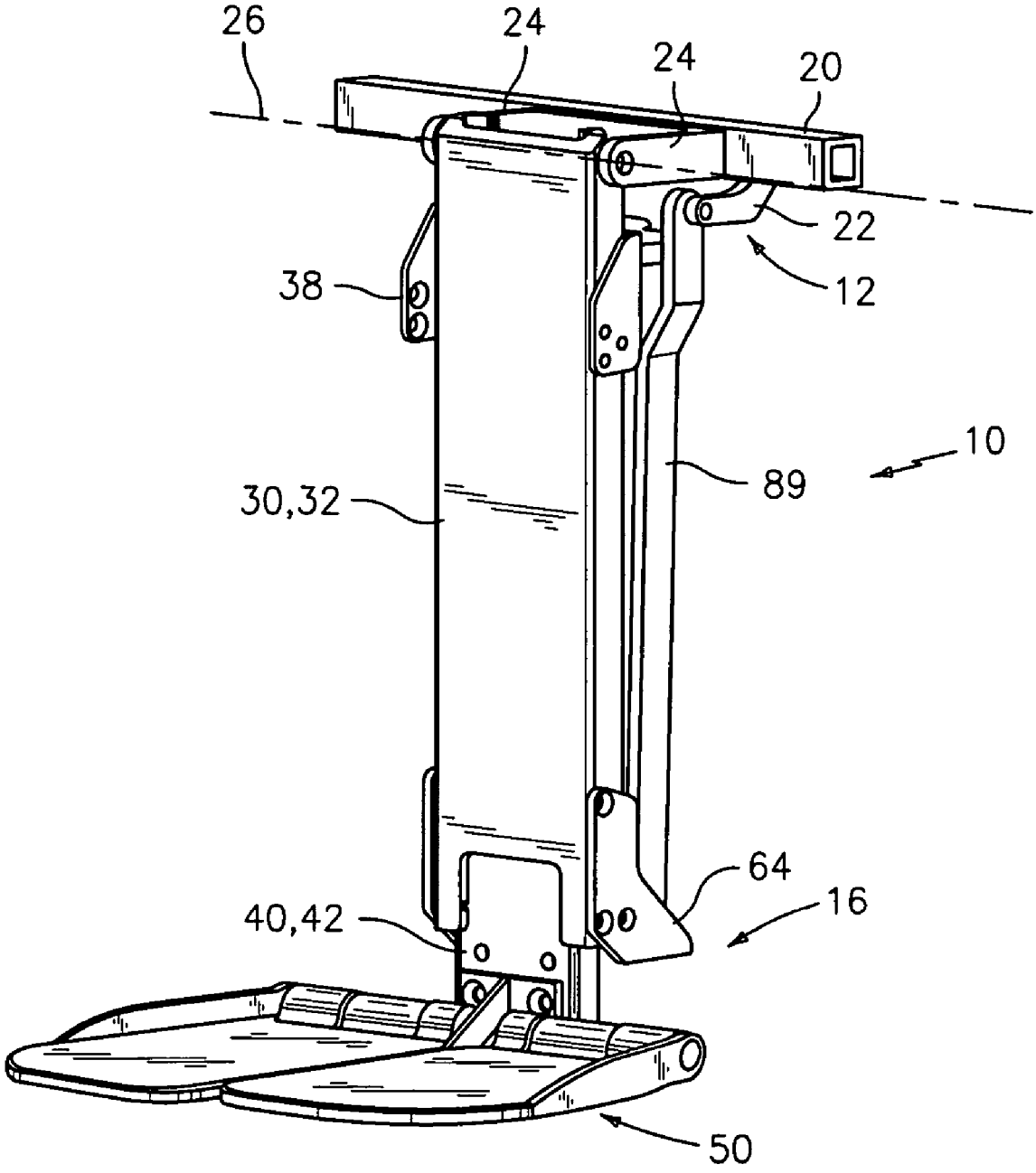
FIG. 1 is a front perspective view of an articulating leg rest in accordance with a preferred embodiment of the present invention, shown in a lowered and retracted position.
Figure 2:
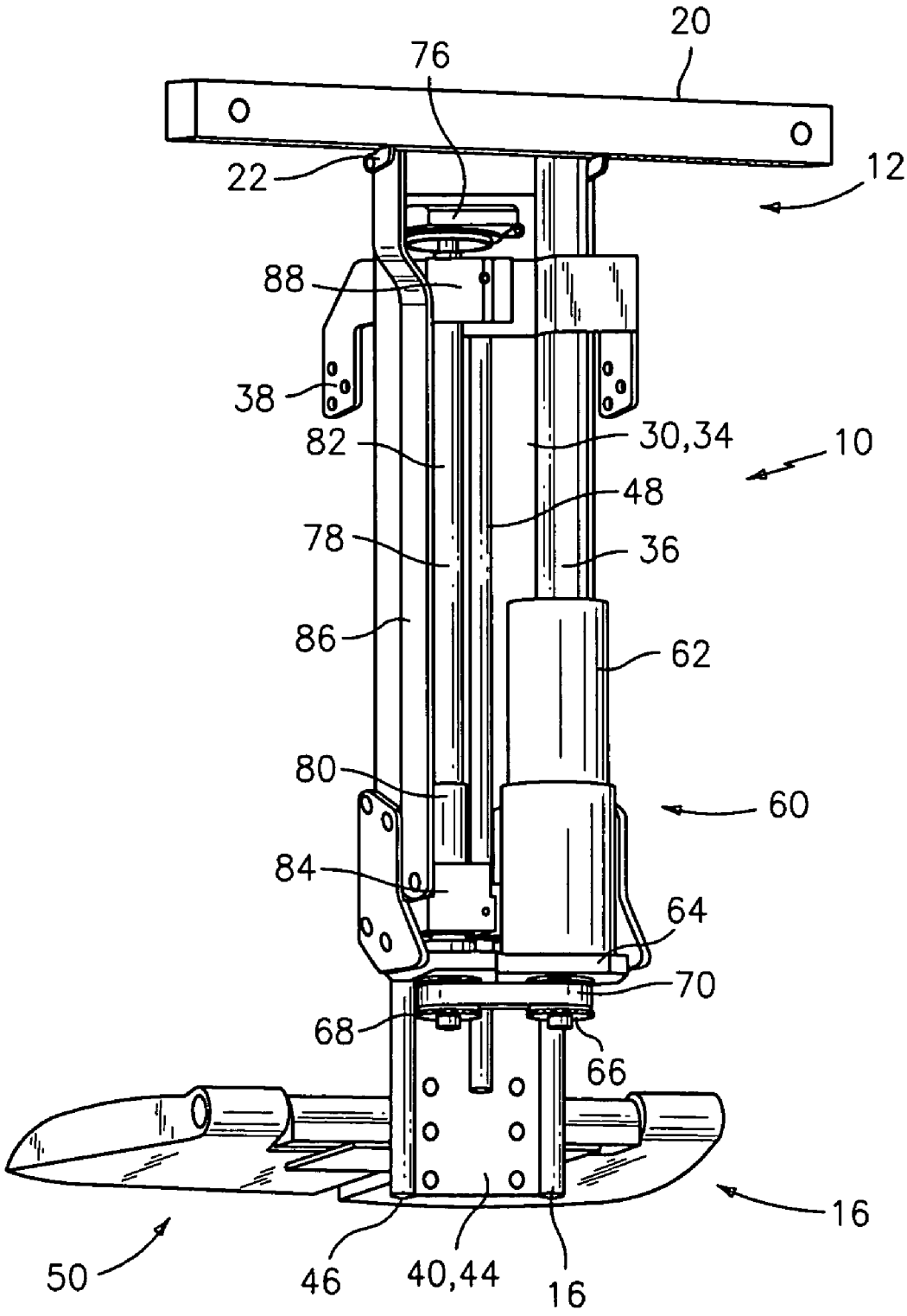
FIG. 2 is a rear perspective view of the articulating leg rest of FIG. 1.
Figure 3:
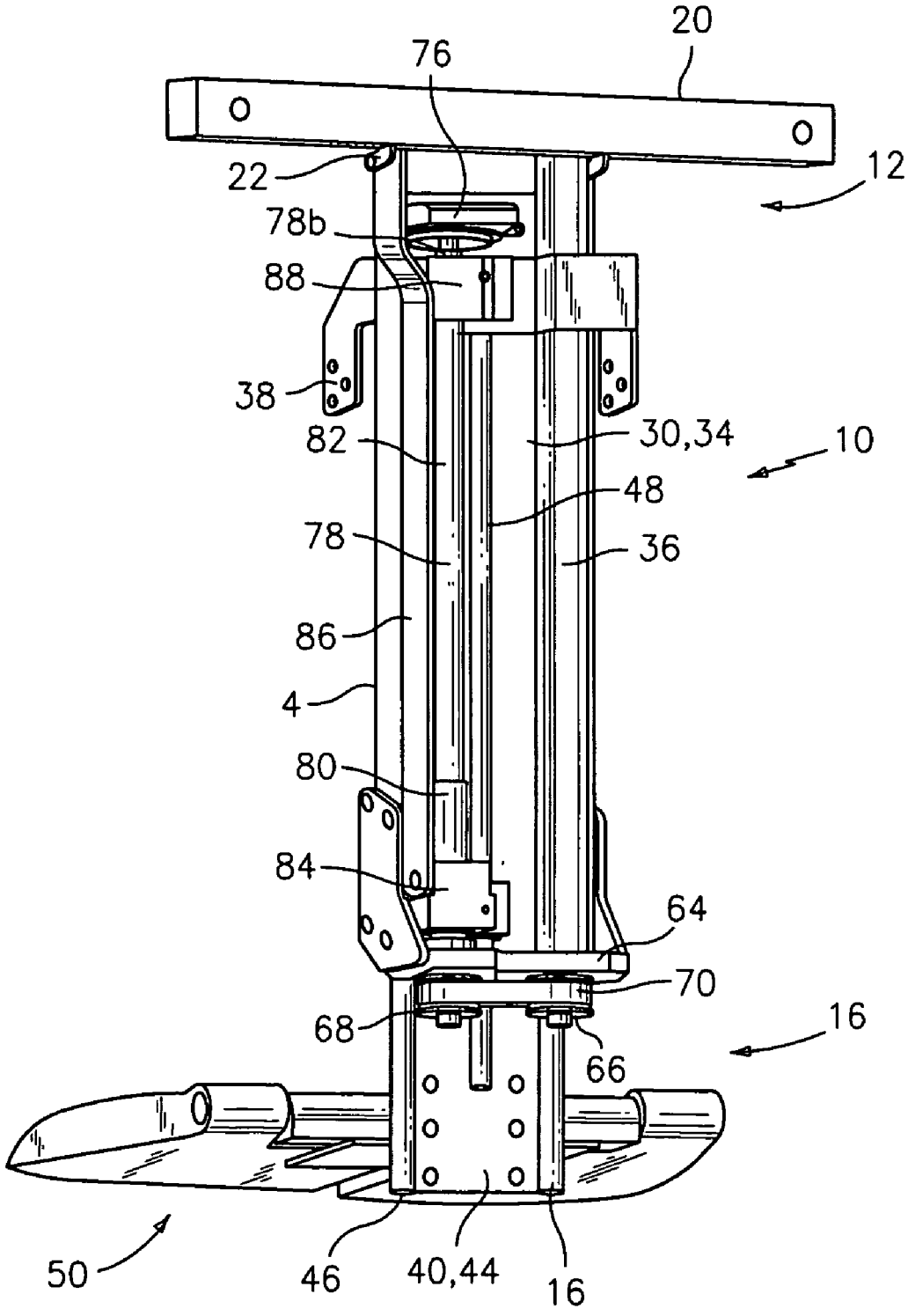
FIG. 3 is a rear perspective view of the articulating leg rest of FIGS. 1 and 2, shown with a motor omitted for clarity.

Referring to the drawings, where like numerals identify like elements, there is illustrated in FIGS. 1-8 an articulating leg rest assembly (or "leg rest") which is generally identified by the reference numeral 10. The leg rest comprises a base frame, a first member, a second member, a foot rest assembly, and a drive system. Preferably, the leg rest is used in combination with a power wheelchair (not illustrated).

The first member 30 is pivotably connected to the base frame 20 for rotation about a pivot axis 26. The base frame 20 preferably includes a link clevis 22 by which a link 86, described further below, is pivotally connected to the base frame 20. The base frame 20 further preferably includes a first member bracket 24 by which the first member 30 is pivotally connected to the base member 20. The base member 20 is preferably connected to a frame of the power wheelchair (not illustrated), or alternatively may be an integral part of the wheelchair frame.

The leg rest 10 pivots between a lowered position 12 (see FIGS. 1-3) and a raised position 14 (see FIGS. 5-8) as the first member 30 and the second member 40 pivot relative to the base frame 20 about pivot axis 26. The first member 30 preferably has a first face 32 and a second face 34. A pair of rail guides 36 are preferably provided on second face 34, sized and shaped to receive a pair of rails 46 described herein below. At a first end, the first member 30 is pivotally connected to the base frame 20 by the first member bracket 24. At a second end, a motor support 64 is fixedly connected to the first member 30.

The second member 40 is telescopically received by the first member for rotation with the first member 30 and for linear translation relative to the first member 30 between a retracted position 16 (see FIGS. 1-3) and an extended position 18 (see FIGS. 5-8). The second member 40 preferably has a first face 42 and a second face 44. The pair of rails 46 are preferably provided on the second face 44, and are preferably formed integrally and unitarily with the a remainder of the second member 40. The rails 46 are sized and shaped to be received within the rail guides 36, maintaining proper alignment and allowing the second member 40 to smoothly translate relative to the first member 30. Furthermore, a guide rod 48 is also preferably provided on the second member second face 44. The guide rod 48 is connected to and cooperates with a second housing 88, described herein below, to allow the drive system 60 to move the second member 40 relative to the first member 30.

The drive system 60 includes a motor 62 supported by the motor support 64. The motor 62 is preferably electrically operated, and is preferably operably coupled to a power source (not shown) of the wheelchair (not shown). Preferably, the power source is a battery. The motor 62 includes an output shaft which is operably connected to a first pulley 66. The first pulley 66 engages a belt, preferably a timing belt 70, which in turn engages a second pulley 68. The second pulley 68 is operably connected to a first end 78*a* of a lead screw assembly (or "lead screw") 78. The lead screw 78 is supported for rotation by a first bearing 72 located proximate the first end 78*a*, and by a second bearing 74 located proximate a second end 78*b* of the lead screw 78. The first bearing 72 is supported by the motor support 64, while the second bearing 74 is supported by a second bearing housing 76. The lead screw 78 is thus operably coupled to the motor 62 for rotation by the first and second pulleys 66, 68 and the timing belt 70.

Figure 4:
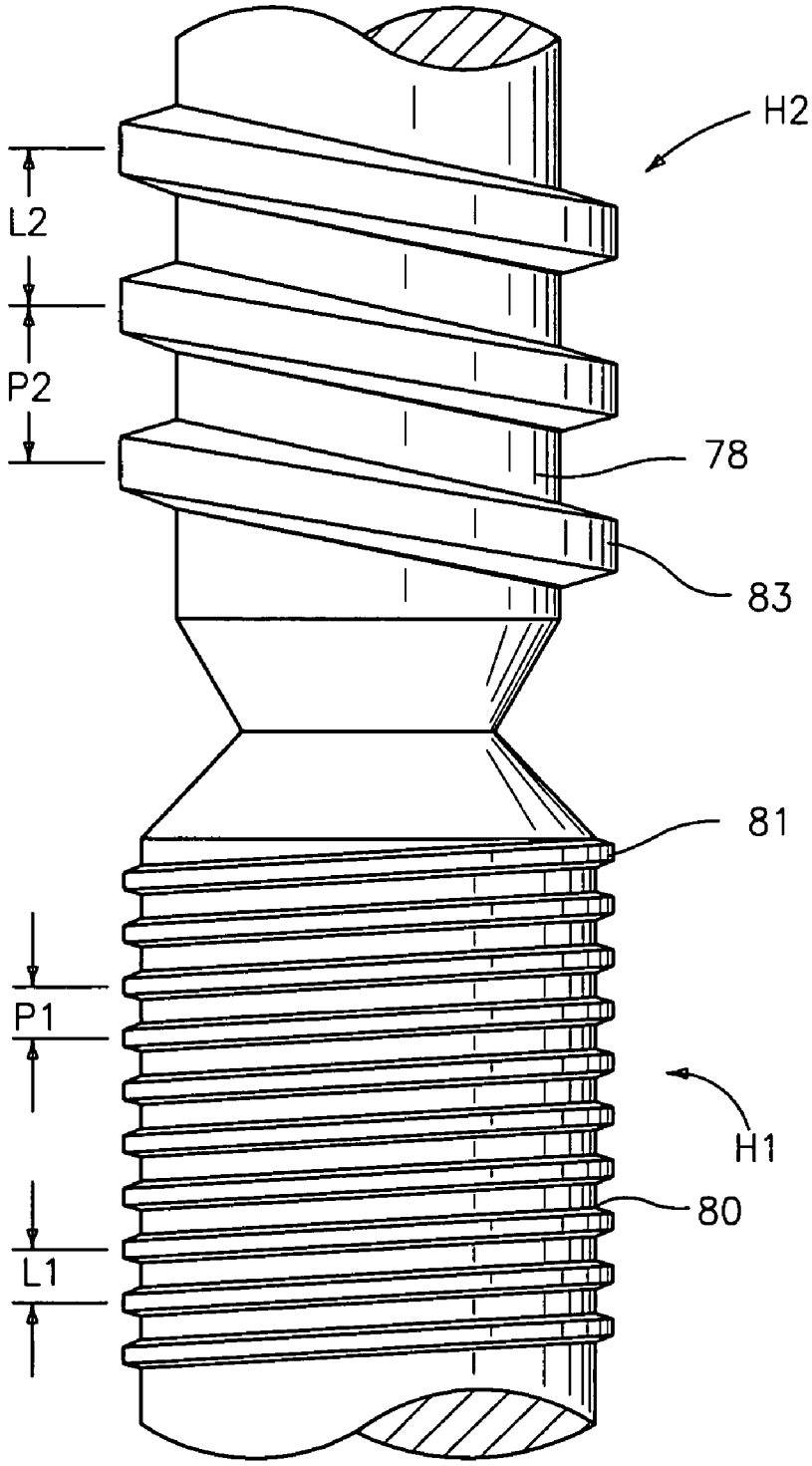
FIG. 4 is an enlarged detail view of a joint between first and second portions of a lead screw assembly of the articulating leg rest of FIG. 1.
Figure 5:
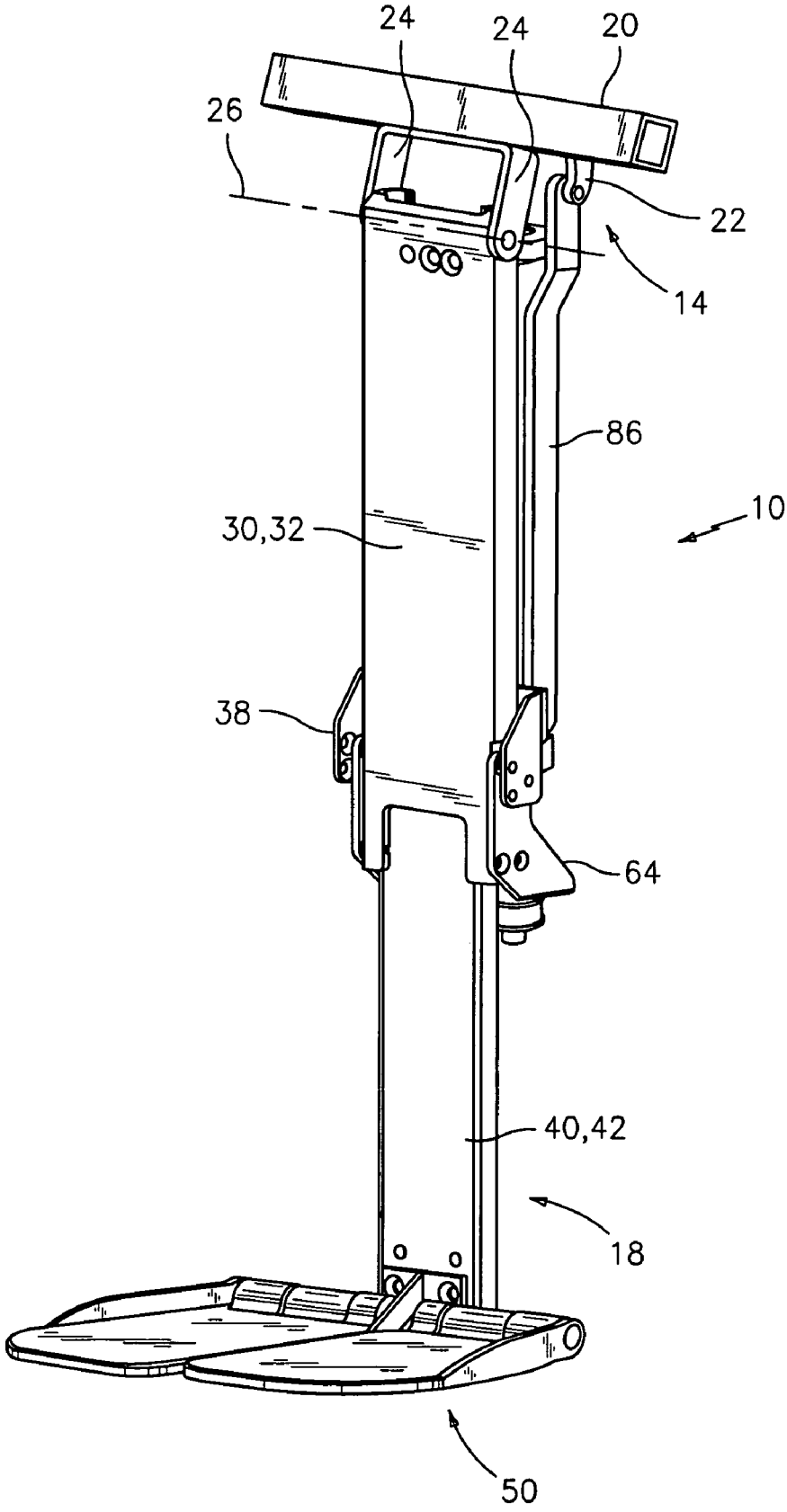
FIG. 5 is a front perspective view of the articulating leg rest of FIG. 1, shown in a raised and extended position.
Figure 6:
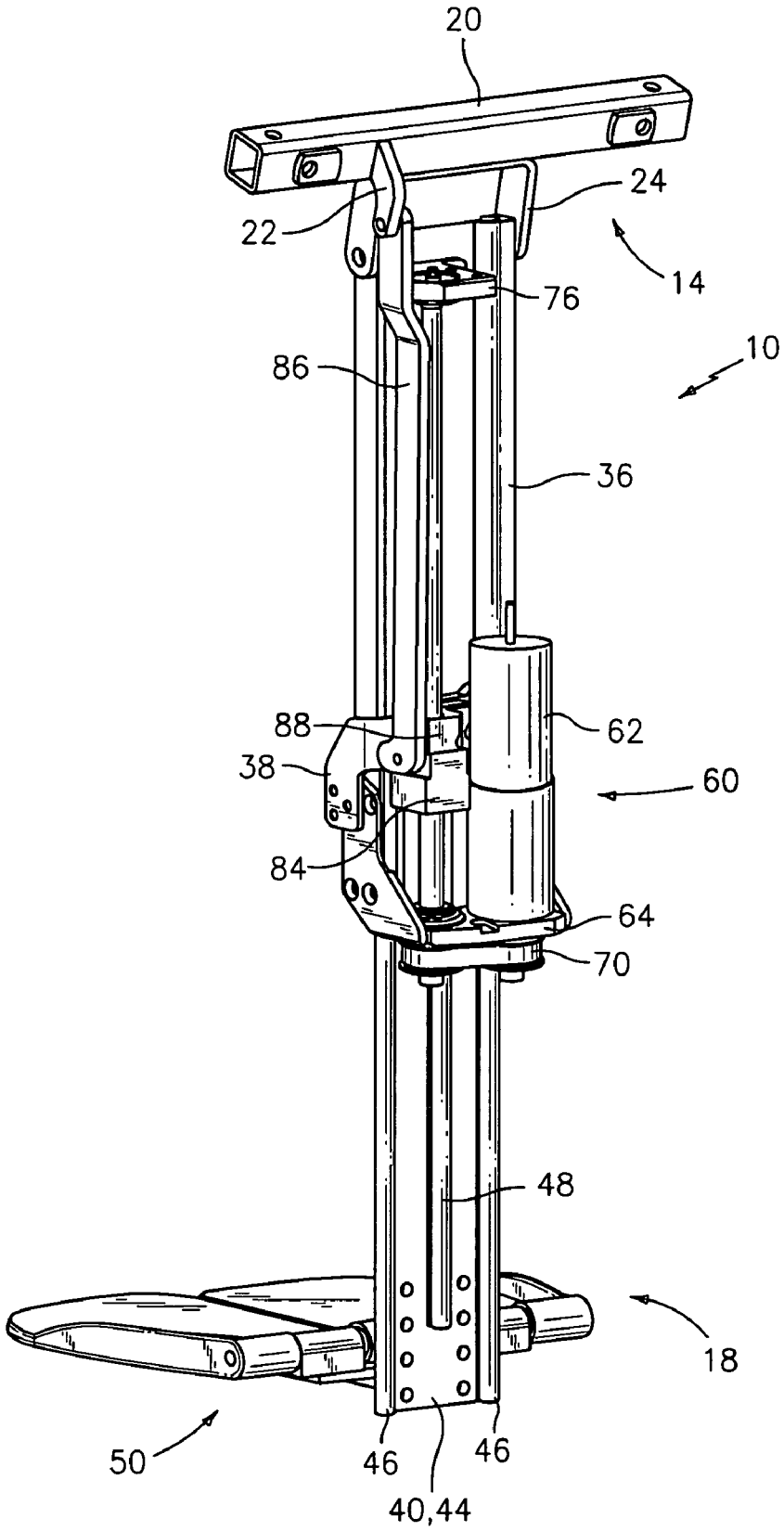
FIG. 6 is a rear perspective view of the articulating leg rest of FIG. 5.
Figure 7:
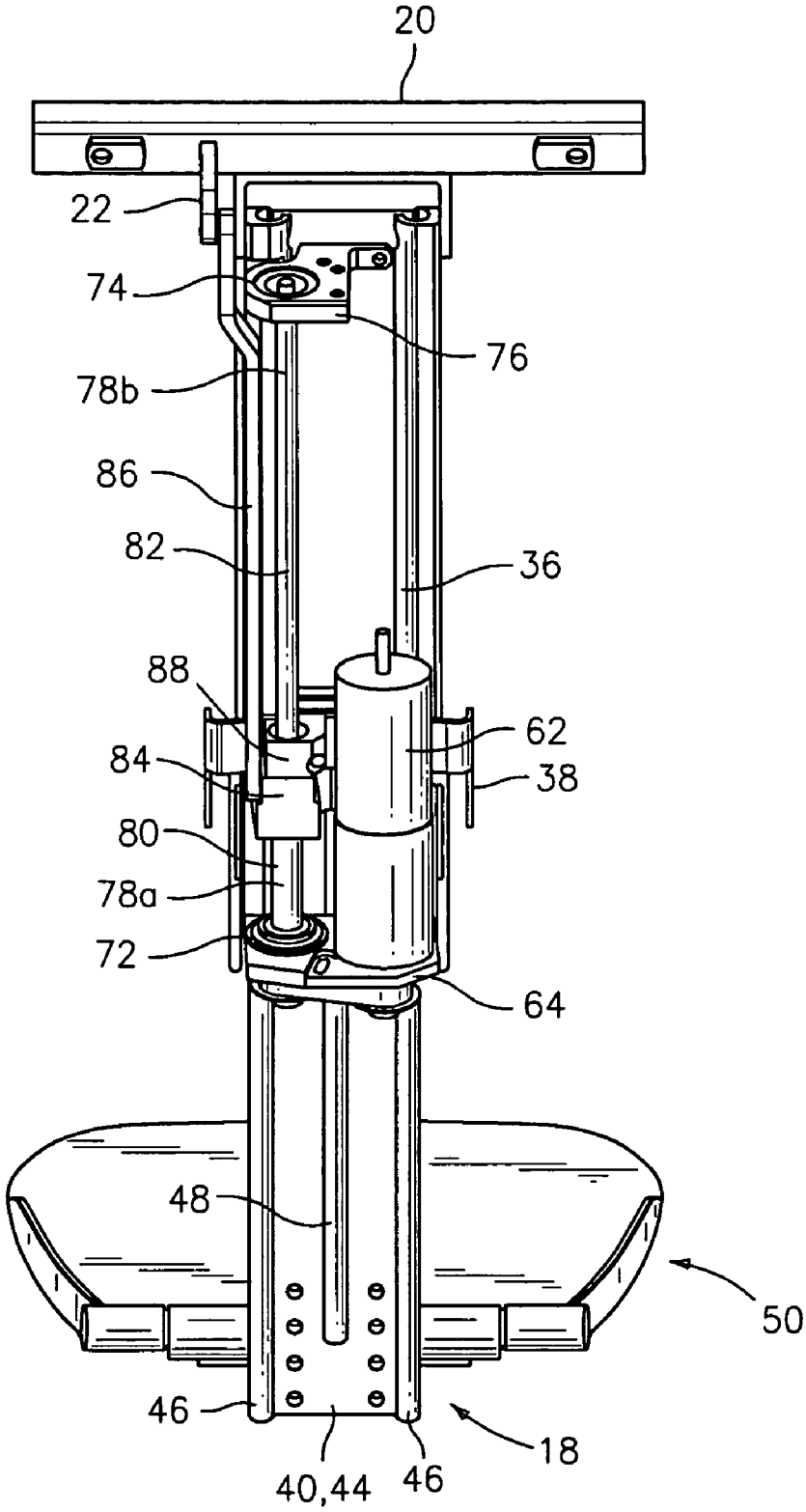
FIG. 7 is a upper rear perspective view of the articulating leg rest of FIG. 5.
Figure 8:
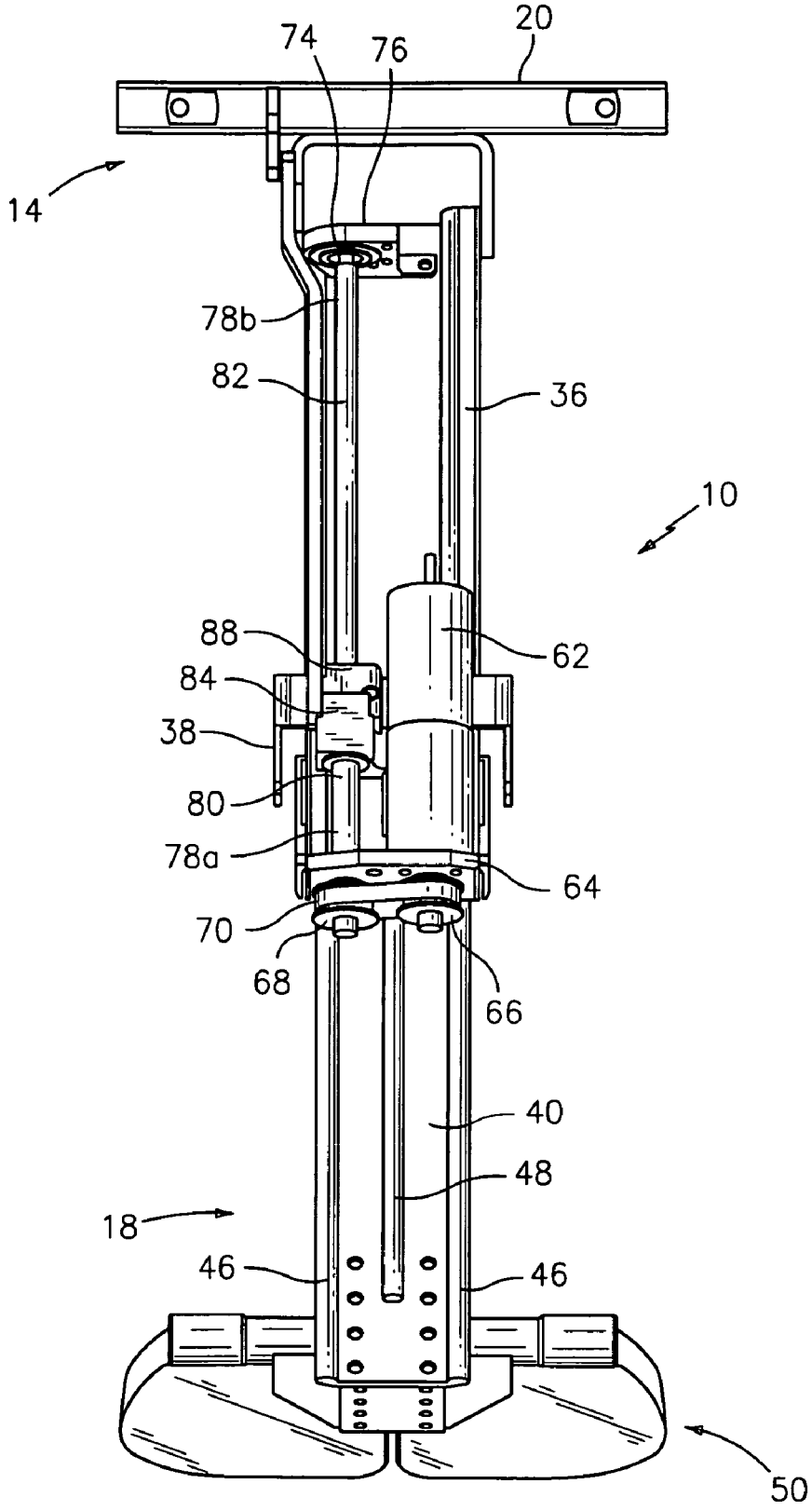
FIG. 8 is a lower rear perspective view of the articulating leg rest of FIG. 5.

The lead screw 78 has a first portion 80 proximate the first end 78*a* and a second portion 82 proximate the second end 78*b*. With particular reference to FIG. 4, the first portion 80 is fixedly connected to the second portion 82, for example by welding or by some other mechanical connection. Preferably the first portion 80 has threads 81 having a first lead L1 and the second portion 82 has threads 83 having a second lead L2. In the case illustrated, the first and second portions 80, 82 are shown to have single start threads, so that the lead equals the pitch of the threads. That is, the first lead L1 equals pitch P1 for threads 81, while the second lead L2 equals the pitch P2 for the threads 83. It will be recognized that alternatively the first and second portions 80 and 82 could be provided with multiple start threads, wherein the lead would equal the pitch multiplied by the number of starts. Preferably, the first portion threads 81 have a lead L1 which is less than the lead L2 of the second portion threads 83.

The drive system 60 further includes a first housing 84 and the second housing 88. Both the first and second housings 84, 88 have an internally threaded portion operably engaged with the lead screw 78. The first housing 84 preferably travels along the first portion 80 and the second housing 88 preferably travels along the second portion 82. As the first portion lead L1 is less than the second portion lead L2, for a given rotation of the lead screw 78, the first housing 84 travels along the lead screw first portion 80 a first distance which is less than a second distance which the second housing 88 travels along the lead screw second portion 82.

Furthermore, the first portion threads 81 preferably have a first handedness H1 while the second portion threads 83 preferably have a second handedness H2. That is, if the first portion threads 81 are right hand threads, then the second portion threads 83 will be left hand threads, or vice versa. Therefore, rotation of the lead screw 78 will cause the first housing 80 to move a first direction along the lead screw 78 (for example, from the first end to the second end), while the second housing 82 will be caused to move a second direction (continuing the example, from the second end to the first end).

A link 86 has a first end operably connected to the first housing 84 and a second end operably coupled to the base frame 20 at the link clevis 22. Rotation of the lead screw 78 moves the first housing 84 and the link 86, causing the first and second elongated members 30, 40 to rotate relative to the base frame 20.

The leg rest 10 comprises conventional materials and is fabricated using conventional manufacturing techniques. For example, the first member 30 may be fabricated from steel or polymeric materials, and may be fabricated using extrusion techniques.

In operation, a user initiates movement of the leg rest 10 using an operating control, including a user interface, such as a manual switch (not shown). The operating control is conventional, and well-known to those of ordinary skill in the art of electromechanical controls. The operating control activates the motor 62. The motor 62 operates to rotate the lead screw assembly 78. The output shaft of the motor 62 will rotate in a first direction to raise the leg rest 10, and will rotate in a second direction to lower the leg rest 10. Rotation of the lead screw 78 translates both the first and second housings 84, 88 along the lead screw first and second portions 80, 82, respectively. As the first housing 84 translates along the first portion 80, the link 86 operates to cause the first and second members 30, 40 to rotate relative to the base frame 20. As the second housing 88 translates along the second portion 82, the second housing 88 engages the guide rod 48 and slides the second member 40 relative to the first member 30. More particularly, in the preferred embodiment illustrated, as the first housing 84 moves from the lead screw first end 78*a* toward the second end 78*b*, the link 86 operates to move the leg rest 10 from the lower position 12 into the raised position 14, and vice versa. As the second housing 88 moves from the lead screw second end 78*b* toward the first end 78*a*, the second housing 88 pushes the second member 40 into the extended position 18 from the retracted position 16, and vice versa.

It will be recognized that the leg rest 10 and drive system 60 could be modified to perform raising and lowering of the leg rest 10 only or extension and retraction of the leg rest 10 only. That is, a rotating leg rest could be provided by omitting the lead screw second portion 82, the second housing 88 and the second member 40, connecting the foot rest assembly 50 to the first member 30. Likewise, an extending and retracting leg rest could be provided by omitting the lead screw first portion 80, connecting the lead screw second portion 82 directly to the second pulley 68, and further omitting the first housing 84 and link 86.

An articulating leg rest 10 is thus provided having a novel, simple, and robust mechanism to extend and retract the leg rest in accordance with rotation of the leg rest.

Although the invention has been described and illustrated with respect to an exemplary embodiment thereof, it should be understood by those skilled in the art that the foregoing and various other changes, omissions and additions may be made therein and thereto, without parting from the spirit and scope of the present invention.

What is claimed is:

1. An articulating leg rest comprising:

a base frame;

a first member pivotably connected to the base frame for rotation about a pivot axis between a lowered position and a raised position;

a second member telescopically received by the first member for rotation with the first member and for linear translation relative to the first member between a retracted position and an extended position;

a drive system including a motor supported by the first member, a lead screw operably coupled to the motor for rotation, the lead screw having a first end and a second end, a first housing having an internally threaded portion operably engaging the lead screw, a link having a first end operably connected to the first housing and a second end operably coupled to the base frame, and a second housing operably engaging the second member and having an internally threaded portion operably engaging the lead screw;

wherein rotation of the lead screw moves the first housing and the link to rotate the first and second members relative to the base frame, and wherein rotation of the lead screw translates the second housing and the second member relative to the first member.

2. The articulating leg rest of claim 1, wherein the lead screw has a first portion proximate the first end, a second portion proximate the second end, the first housing travels along the first portion and the second housing travels along the second portion.

3. The articulating leg rest of claim 2, wherein the first portion has threads with a first lead and the second portion has threads with a second lead.

4. The articulating leg rest of claim 3, wherein the first lead is less than the second lead, such that for a given rotation of the lead screw, the first housing advances along the lead screw a distance which is less than a second distance which the second housing advances along the lead screw.

5. The articulating leg rest of claim 2, wherein the first portion threads have a first handedness and the second portion threads have a second handedness such that rotation of the lead screw causes the first housing to move a first direction and the second housing to move a second direction.

6. The articulating leg rest of claim 5, wherein the first housing advances away from the first end toward the second end as the first member pivots from the lowered position to the raised position and the second housing advances away from the second end toward the first end as the second member is translated from the retracted position to the extended position.

7. The articulating leg rest of claim 2, wherein the first portion has threads with a first pitch and the second portion has threads with a second pitch.

8. The articulating leg rest of claim 7, wherein the first pitch is less than the second pitch, and the distance moved by the first housing per rotation of the lead screw is less than the distance moved by the second housing.

9. The articulating leg rest of claim 1, further comprising a foot rest connected to the second member.

10. The articulating leg rest of claim 1 in combination with a power wheelchair having a frame, wherein the base frame is connected to the wheelchair frame.

11. The articulating leg rest of claim 1 wherein the lead screw, first housing, and second housing are provided with Acme style threads.

12. A rotating leg rest comprising:

a base frame;

a first member pivotably connected to the base frame for rotation about a pivot axis between a lowered position and a raised position;

a drive system including a motor supported by the first member, a lead screw operably connected to the motor for rotation, a housing having an internally threaded portion operably engaging the lead screw, a link having a first end operably and pivotally connected to the housing and a second end operably coupled to the base frame, wherein rotation of the lead screw advances the housing along the lead screw and moves the link to rotate the first member relative to the base frame.

13. The rotating leg rest of claim 12, wherein the lead screw has a first end and an opposite second end, the second end adjacent the base frame and wherein the housing advances away from the first end toward the second end as the first member pivots from the lowered position to the raised position.

14. The rotating leg rest of claim 12, wherein the housing advances along the lead screw substantially vertically with respect to the base frame.

15. The rotating leg rest of claim 14, wherein the link extends substantially vertically with respect to the base frame.

16. An extending and retracting leg rest comprising:

a base frame;

a first member connected to the base frame, the first member disposed substantially vertically with respect to the base frame;

a second member telescopically received by the first member for linear translation relative to the first member;

a drive system including a motor supported by the first member, a lead screw operably coupled to the motor for rotation, a housing operably engaging the second member and having an internally threaded portion operably engaging the lead screw;

wherein rotation of the lead screw linearly translates the housing and the second member relative to the first member.

17. The extending and retracting leg rest of claim 16 further comprising a footrest connected to the second member, wherein rotation of the lead screw linearly translates the footrest relative to the first member.

* * * * *